US008656964B1

(12) United States Patent
Chu

(10) Patent No.: US 8,656,964 B1
(45) Date of Patent: Feb. 25, 2014

(54) AUTO-FILLING ASSEMBLY FOR A REFILLABLE SPRAYER

(71) Applicant: Bo-Lang Chu, Taichung (TW)

(72) Inventor: Bo-Lang Chu, Taichung (TW)

( * ) Notice: Subject to any disclaimer, the term of this patent is extended or adjusted under 35 U.S.C. 154(b) by 0 days.

(21) Appl. No.: 13/633,871

(22) Filed: Oct. 2, 2012

(51) Int. Cl.
*B65B 1/04* (2006.01)

(52) U.S. Cl.
USPC ..... 141/20; 141/104; 141/105; 141/351

(58) Field of Classification Search
USPC ..... 141/20, 20.5, 64, 100, 104, 105, 351
See application file for complete search history.

(56) References Cited

U.S. PATENT DOCUMENTS

| | | | | |
|---|---|---|---|---|
| 3,592,244 | A * | 7/1971 | Chamberlin | 141/14 |
| 5,092,750 | A * | 3/1992 | Leroy et al. | 417/571 |
| 5,343,904 | A * | 9/1994 | Kaeser | 141/20 |
| 8,448,677 | B2 * | 5/2013 | Ficai et al. | 141/113 |

* cited by examiner

*Primary Examiner* — Jason K Niesz
(74) *Attorney, Agent, or Firm* — Pai Patent & Trademark Law Firm; Chao-Chang David Pai

(57) ABSTRACT

An auto-filling assembly for a refillable sprayer has a base device, a controlling device and a filling device. The base device has a base, an oil tank and a connecting jacket. The connecting jacket is mounted on the base and has a connecting disk, a switch and an engaging mount. The controlling device is connected to the base device and has an inlet valve, a first linking valve, a gas-controlling valve, a second linking valve and a triple valve. The filling device is mounted on the base device, is connected to the controlling device and has a storage bottle, a release valve and a mechanical valve. The auto-filling assembly can be used to fill pressurized gas and oil into a refillable sprayer conveniently and automatically.

10 Claims, 7 Drawing Sheets

AUTO-FILLING ASSEMBLY FOR A REFILLABLE SPRAYER

BACKGROUND OF THE INVENTION

1. Field of the Invention

The present invention relates to an auto-filling assembly, and more particularly to an auto-filling assembly for a refillable sprayer; the auto-filling assembly can be operated to fill oil and gas in a refillable sprayer conveniently and automatically.

2. Description of Related Art

A conventional sprayer has pressurized gas and oil at a suitable ratio, such that the oil can be uniformly sprayed out of the conventional sprayer by the pressurized gas. However, the conventional sprayer is not refillable and therefore is not environmentally friendly, and once the pressurized gas is completely discharged, oil remaining in the sprayer is useless and wasted.

According to the above-mentioned problem of the conventional sprayer, a refillable sprayer is developed. When the pressurized gas of the refillable sprayer is completely discharged, a quantitative stuffer and a gas-filled tube can be used to fill the pressurized gas and oil into the refillable sprayer manually to maintain the pressurized gas and oil that are filled into the refillable sprayer at a specific ratio. However, the user needs the quantitative stuffer and the gas-filled tube to fill the pressurized gas and oil into the refillable sprayer, and the quantitative stuffer cannot be used again and this will increase the cost of using the refillable sprayer. In addition, the user needs to fill the pressurized gas and oil into the refillable sprayer manually and this is inconvenient in use.

To overcome these shortcomings, the present invention provides an auto-filling assembly for a refillable sprayer to mitigate or obviate the aforementioned problems.

SUMMARY OF THE INVENTION

The primary objective of the present invention is to provide an auto-filling assembly for a refillable sprayer; the auto-filling assembly can be operated to fill oil and gas in a refillable sprayer conveniently and automatically.

The auto-filling assembly for a refillable sprayer in accordance with the present invention has a base device, a controlling device and a filling device. The base device has a base, an oil tank and a connecting jacket. The connecting jacket is mounted on the base and has a connecting disk, a switch and an engaging mount. The controlling device is connected to the base device and has an inlet valve, a first linking valve, a gas-controlling valve, a second linking valve and a triple valve. The filling device is mounted on the base device 10, is connected to the controlling device and has a storage bottle, a release valve and a mechanical valve. The auto-filling assembly can be used to fill pressurized gas and oil into a refillable sprayer conveniently and automatically.

Other objects, advantages and novel features of the invention will become more apparent from the following detailed description when taken in conjunction with the accompanying drawings.

DETAILED DESCRIPTION OF PREFERRED EMBODIMENT

Figure 1:
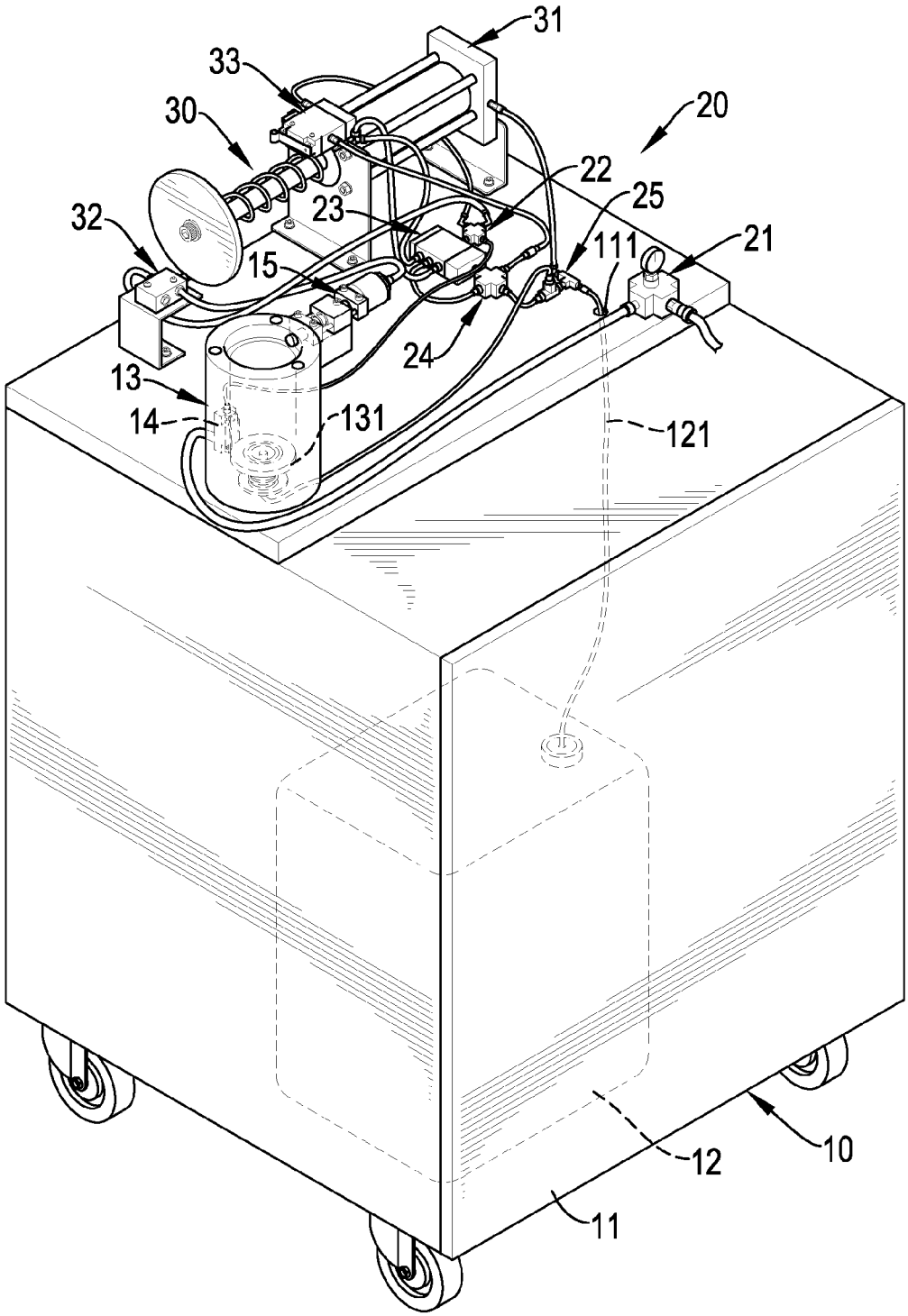
FIG. 1 is a perspective view of an auto-filling assembly for a refillable sprayer in accordance with the present invention.
Figure 2:
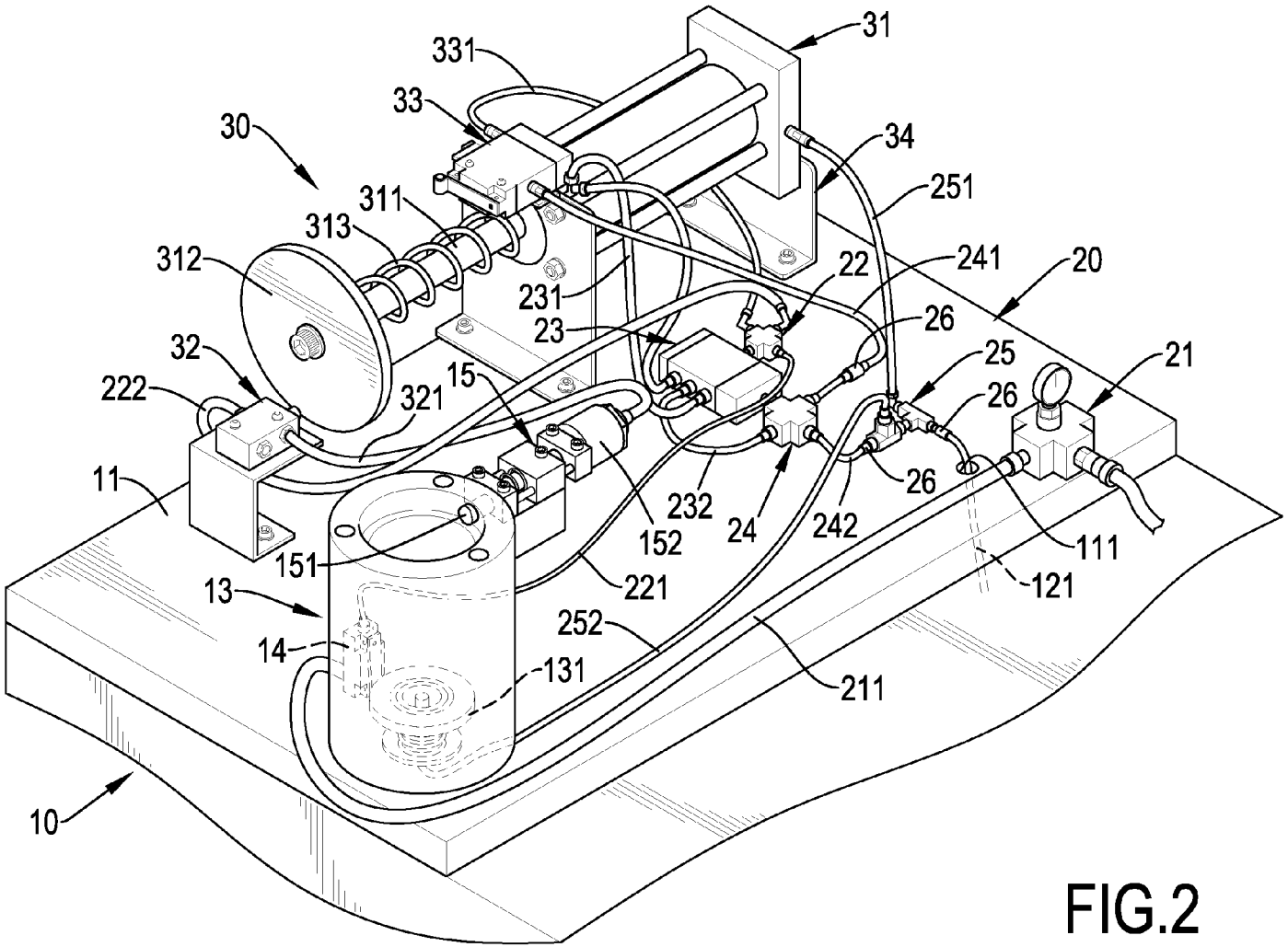
FIG. 2 is an enlarged perspective view of the auto-filling assembly for a refillable sprayer in FIG. 1.
Figure 3:
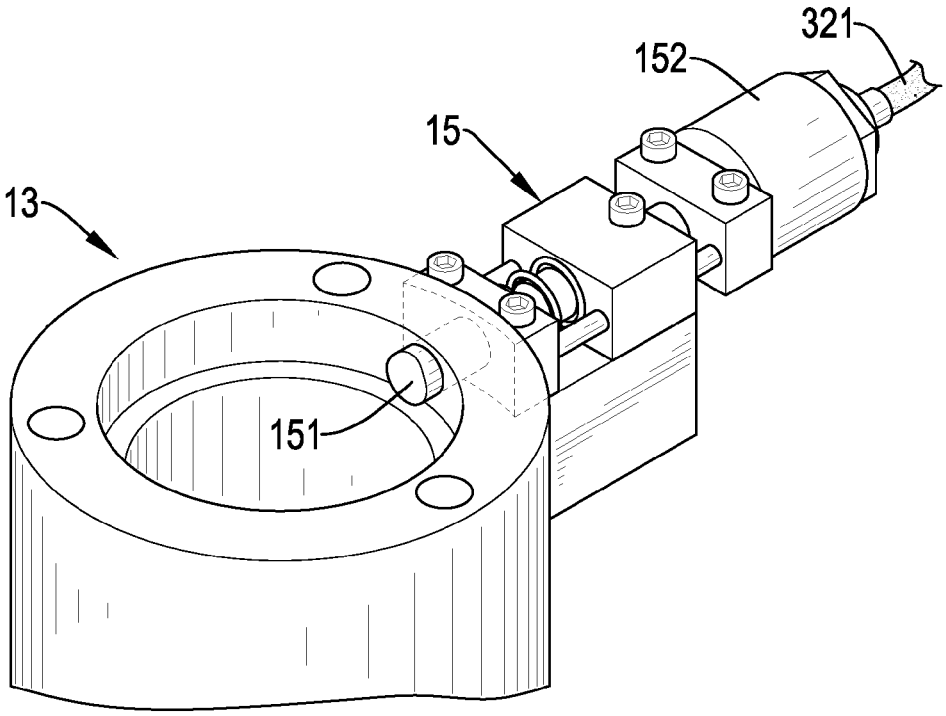
FIG. 3 is an enlarged perspective view of an engaging mount of a base device of the auto-filling assembly for a refillable sprayer in FIG. 1.

With reference to FIGS. 1 to 3, an auto-filling assembly for a refillable sprayer in accordance with the present invention comprises a base device 10, a controlling device 20 and a filling device 30.

The base device 10 has a base 11, an oil tank 12 and a connecting jacket 13. The base 11 may be rectangular and has a top face and a through hole 111. The through hole 111 is formed through the top face of the base 11. The oil tank 12 is mounted in the base 11 to store oil and has a transfer pipe 121 extending out of the top face of the base 11 via the through hole 111.

The connecting jacket 13 is hollow, is securely mounted on the top face of the base 11 and has a bottom end, a top end, an external surface, a connecting disk 131, a switch 14 and an engaging mount 15. The connecting disk 131 is movably mounted in the connecting jacket 13 at the bottom end of the connecting jacket 13 and has a spring mounted in a bottom of the connecting disk 131 to enable the connecting disk 131 to move upwardly relative to the connecting jacket 13. The switch 14 is mounted on the external surface of the connecting jacket 13 near the bottom end of the connecting jacket 13 and has a touching leg extending into the connecting jacket 13.

The engaging mount 15 is securely mounted on the external surface of the connecting jacket 13 near the top end of the connecting jacket 13 and has an inner side, an outer side, a pressure cylinder 152 and an engaging rod 151. The inner side of the engaging mount 15 abuts the external surface of the connecting jacket 13. The pressure cylinder 152 is securely mounted on the outer side of the engaging mount 15. The engaging rod 151 is connected to the pressure cylinder 152 to be movably mounted in the engaging mount 15 and extends into the connecting jacket 13 via the inner side of the engaging mount 15 and the external surface of the connecting jacket 13.

The controlling device 20 is connected to the base device 10 and has an inlet valve 21, a first linking valve 22, a gas-controlling valve 23, a second linking valve 24 and a triple valve 25.

The inlet valve 21 is mounted on the top face of the base 11, is connected to an air compressor and has an air pipe 211 connected to the switch 14. The first linking valve 22 is mounted on the top face of the base 11, is connected to the switch 14 and has a first inlet-connecting pipe 221 and a first outlet-connecting pipe 222. The first inlet-connecting pipe 221 is connected to the switch 14 and communicates with the air pipe 211 of the inlet valve 21 via the switch 14.

The gas-controlling valve 23 is mounted on the top face of the base 11, is connected to the first linking valve 22 and has an inlet controlling pipe 231 and an outlet controlling pipe 232. The second linking valve 24 is mounted on the top face of the base 11, is connected to the outlet controlling pipe 232 of the gas-controlling valve 23 and has a second inlet-connecting pipe 241 and a second outlet-connecting pipe 242. The triple valve 25 is mounted on the top face of the base 11, is connected to the second outlet-connecting pipe 242 of the second linking valve 24 and the transfer pipe 121 of the oil tank 12, and has an oil entrance pipe 251 and an oil-gas filling pipe 252. The oil-gas filling pipe 252 is connected to a center of the connecting disk 131 via the bottom end of the connecting jacket 13. Preferably, the controlling device 20 has multiple reverse valves 26 respectively mounted on the second inlet-connecting pipe 241, the second outlet-connecting pipe 242 and the transfer pipe 121.

The filling device 30 is mounted on the base device 10, is connected to the controlling device 20 and has a storage bottle 31, a release valve 32 and a mechanical valve 33.

The storage bottle 31 is transversally mounted on the top face of the base 11 by a mounting frame 34, is connected to the oil entrance pipe 251 and the inlet controlling pipe 231 of the controlling device 20, and is used to store oil for filling into a refillable sprayer. The storage bottle 31 has a distal end, a proximal end, an extruding shaft 311, a touching panel 312 and a returning spring 313. The extruding shaft 311 is movably connected to the distal end of the storage bottle 31 and has a free end opposite to the storage bottle 31. The touching panel 312 is connected to the free end of the extruding shaft 311 and has an inner side and an outer side. The returning spring 313 is mounted around the extruding shaft 311 and abuts the inner side of the touching panel 312 and the distal end of the storage bottle 31.

The release valve 32 is securely mounted on the top face of the base 11, is connected to the first outlet-connecting pipe 222 of the first linking valve 22 and selectively abuts the outer side of the touching panel 312 of the storage bottle 31. The release valve 32 has a release pipe 321 connected to the pressure cylinder 152 of the engaging mount 15 to enable the engaging rod 151 to move relative to the connecting jacket 13.

The mechanical valve 33 is mounted on the mounting frame 34 above the storage bottle 31, is connected to the second inlet-connecting pipe 241 of the second linking valve 24 and selectively abuts the inner side of the touching panel 312. The mechanical valve 33 has a linking pipe 331 communicating with the first linking valve 22.

Figure 4:
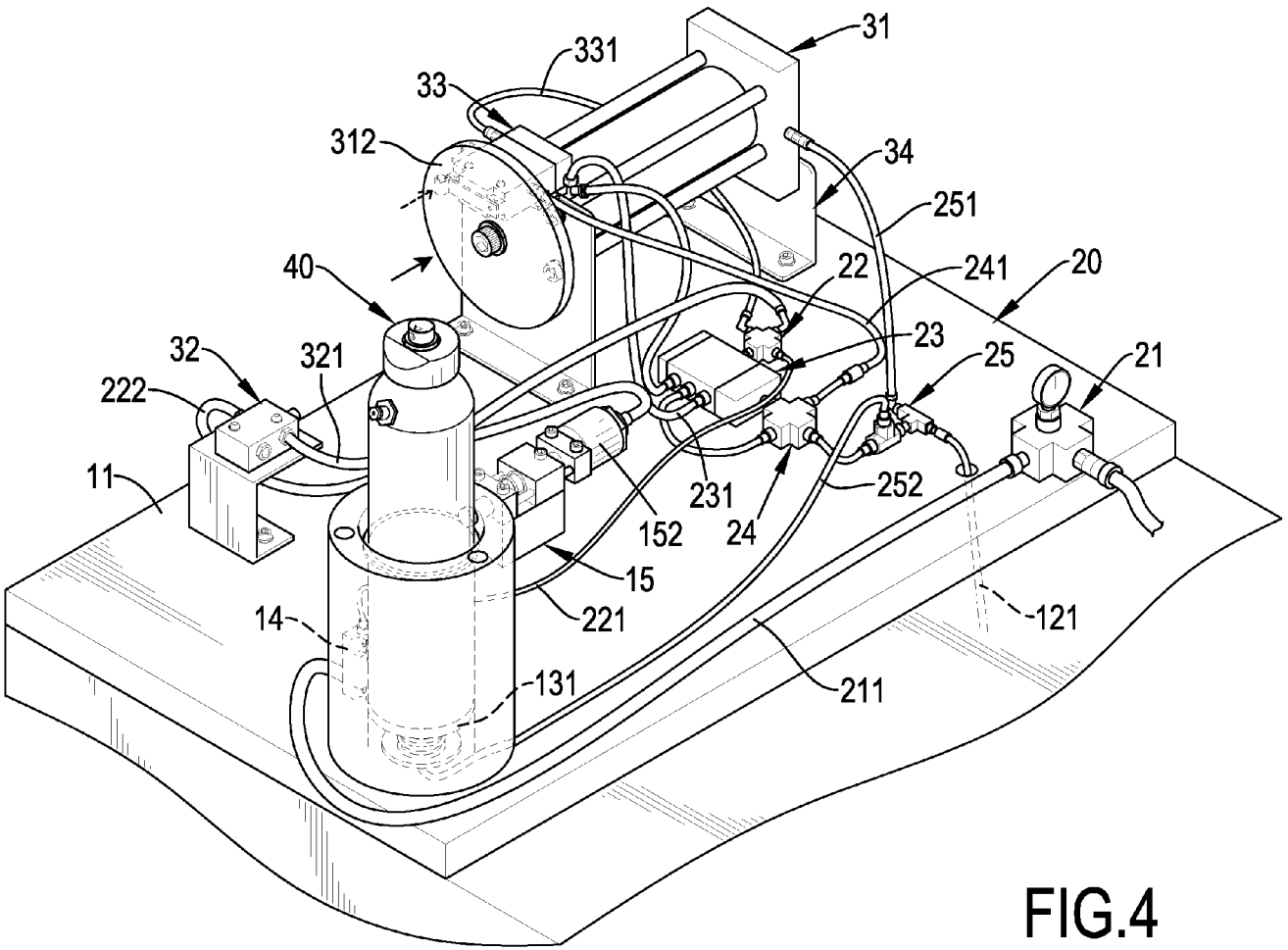
FIG. 4 is an operational perspective view of the auto-filling assembly for a refillable sprayer in FIG. 1 filling oil into a refillable sprayer.
Figure 5:
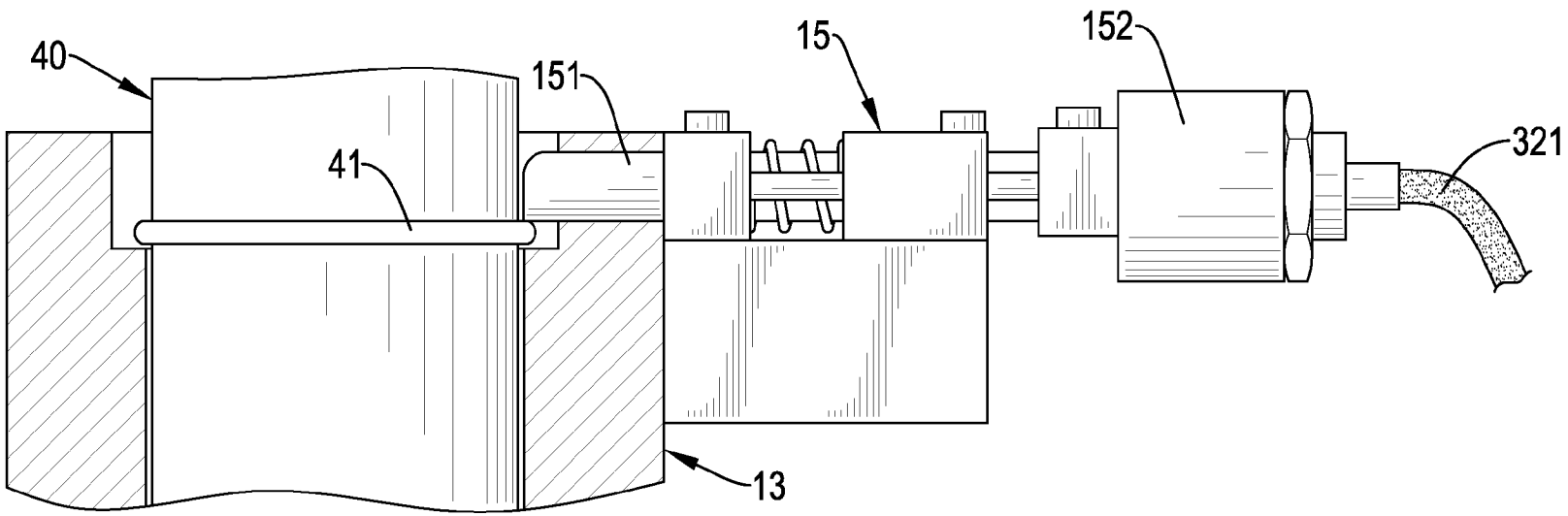
FIG. 5 is an enlarged and operational side view in partial section of the auto-filling assembly for a refillable sprayer in FIG. 4 engaging with a refillable sprayer.

With reference to FIGS. 2 to 4, the auto-filling assembly for a refillable sprayer in accordance with the present invention is used to fill oil and gas into a refillable sprayer 40 with an engaging ring 41. First, the inlet valve 21 is connected to an air compressor to provide pressurized gas and oil stored in the storage bottle 31. A refillable sprayer 40 is mounted in the connecting jacket 13 to abut against the connecting disk 131 to compress the spring of the connecting disk 131 and to enable the engaging ring 41 of the refillable sprayer 40 to be mounted into the connecting jacket 13 near the top end of the connecting jacket 13. With reference to FIG. 5, when the engaging ring 41 of the refillable sprayer 40 is moved into the connecting jacket 13, the engaging rod 151 of the engaging mount 15 will engage the engaging ring 41 of the refillable sprayer 40 to hold the refillable sprayer 40 securely in the connecting jacket 13. In addition, when the refillable sprayer 40 is held securely in the connecting jacket 13, a bottom of the refillable sprayer 40 communicates with the oil-gas filling pipe 252 of the triple valve 25.

When the refillable sprayer 40 is mounted and held in the connecting jacket 13, the refillable sprayer 40 will abut the touching leg of the switch 14 to actuate the switch 14. Then, the pressurized gas that is provided by the air compressor flows into the gas-controlling valve 23 via the air pipe 211 of the inlet valve 21, the first inlet-connecting pipe 221 and the first linking valve 22. The pressurized gas flows into the storage bottle 31 via the inlet controlling pipe 231 of the gas-controlling valve 23 to enable the extruding shaft 311 to move toward the storage bottle 31. Then, the oil that is stored in the storage bottle 31 is extruded out of the storage bottle 31 and is filled into the refillable sprayer 40 via the oil entrance pipe 251, the triple valve 25 and the oil-gas filling pipe 252.

When the oil is filled into the refillable sprayer 40, the extruding shaft 311 is moved toward the storage bottle 31 to enable the touching panel 312 to move close to the mechanical valve 33. When the inner side of the touching panel 312 abuts and actuates the mechanical valve 33, the pressurized gas in the first linking valve 22 will flow into the gas-controlling valve 23 via the linking pipe 331, the second inlet-connecting pipe 241 and the second linking valve 24. As the pressurized gas flows into the mechanical valve 33, the pressurized gas will flow and be filled into the refillable sprayer 40 via the outlet controlling pipe 232, the second linking valve 24, the triple valve 25 and the oil-gas filling pipe 252.

Figure 6:
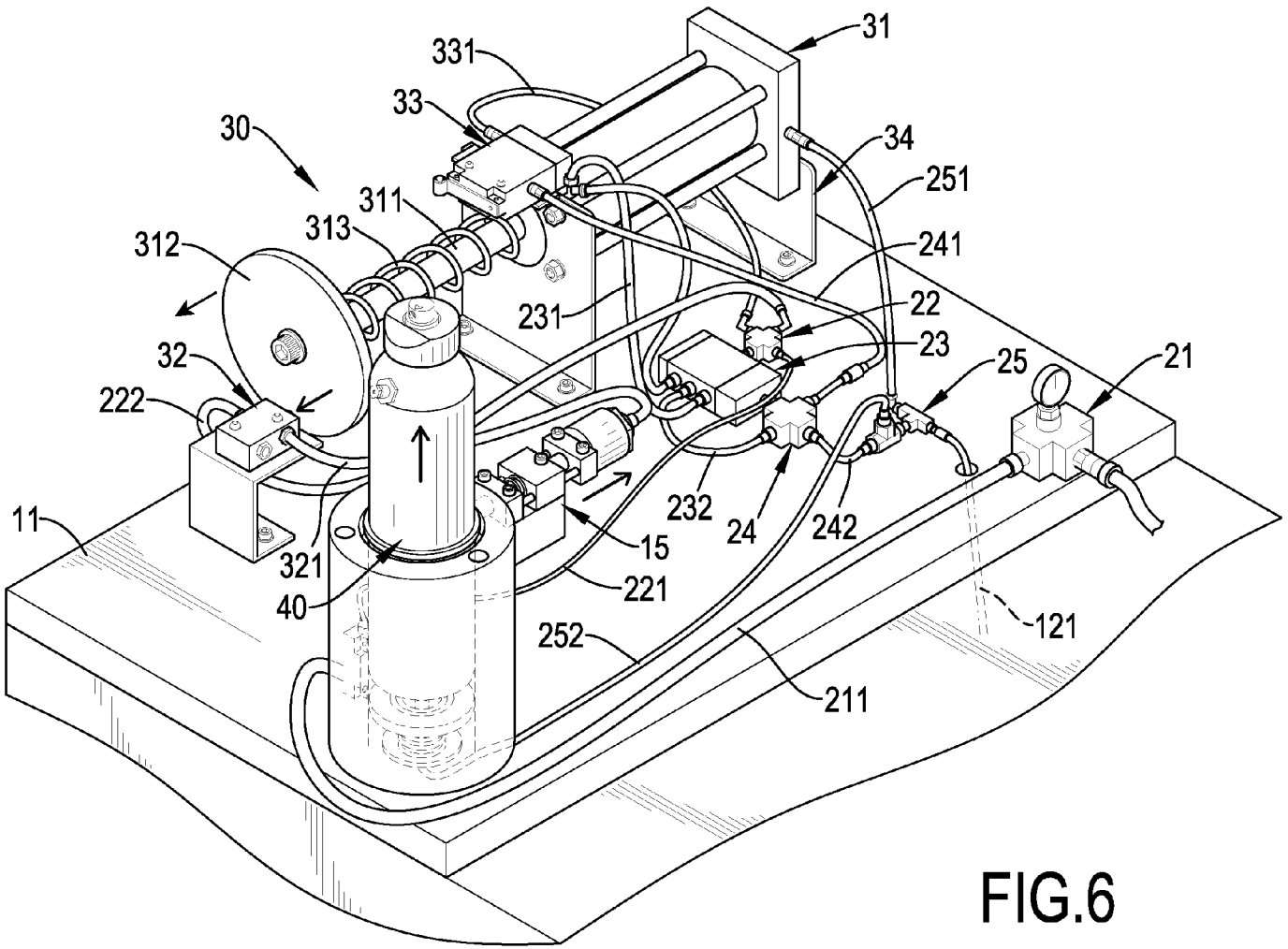
FIG. 6 is an operational perspective view of the auto-filling assembly for a refillable sprayer in FIG. 1 filling pressurized gas into a refillable sprayer.

Furthermore, when the pressurized gas is filled into the refillable sprayer 40, the pressurized gas that originally flows in the inlet controlling pipe 231 will flow into the second linking valve 24 via the outlet controlling valve 232. Then, the extruding shaft 311 cannot be driven by the pressurized gas to move relative to the storage bottle 31, and the touching panel 312 can be pushed back to the original position by the returning spring 313 as shown in FIG. 6. When the touching panel 312 moves back to the original position with the extruding shaft 311, the oil that is stored in the oil tank 12 will flow and be filled into the storage bottle 31 via the transfer pipe 121, the triple valve 25 and the oil entrance pipe 251 by an extruding force that is provided by the returning spring 313. Then, the storage bottle can be used to fill oil into another refillable sprayer 40.

Figure 7:
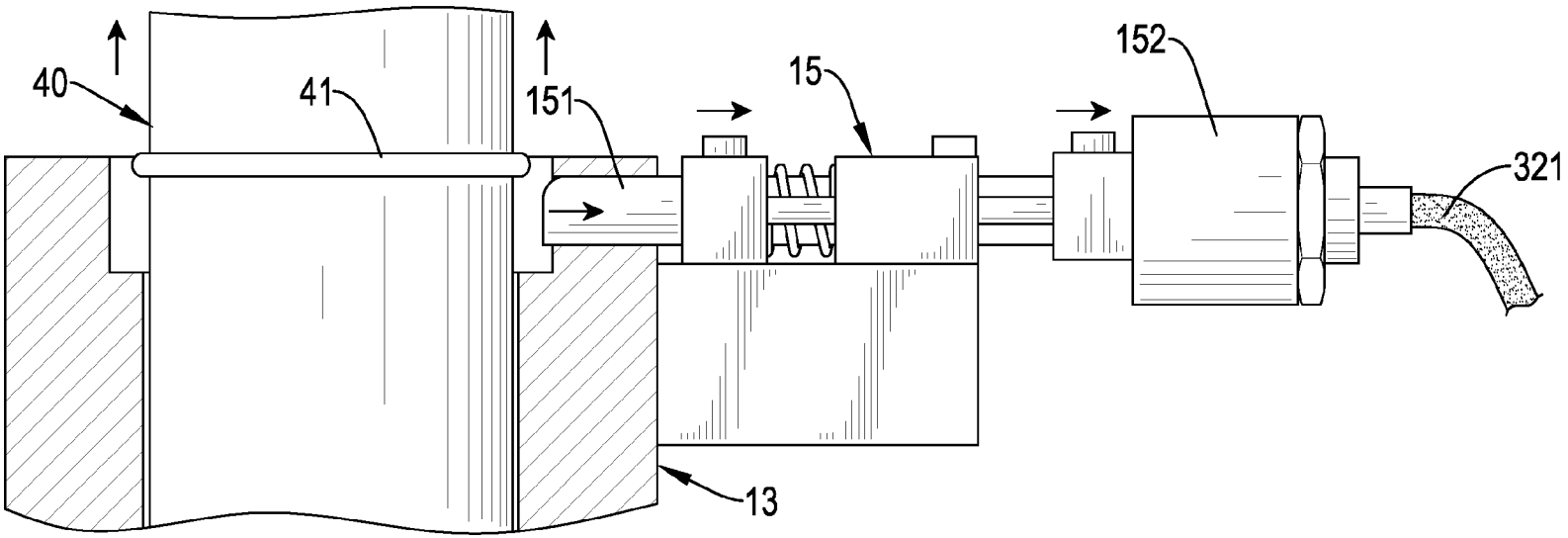
FIG. 7 is an enlarged and operational side view in partial section of the auto-filling assembly for a refillable sprayer in FIG. 4 disengaging from a refillable sprayer.

Additionally, when the pressurized gas is filled into the exhausted refillable sprayer 40, the extruding shaft 311 and the touching panel 312 move back to the original position by an elastic force of the returning spring 313 to enable the outer side to abut and actuate the release valve 32. Then, the pressurized gas will flow into the pressure cylinder 152 via the first outlet-connecting pipe 222 of the first linking valve 22, the release valve 32 and the release pipe 321 to drive the engaging rod 151 to move and to disengage from the engaging ring 41 of the refillable sprayer 40 as shown in FIG. 7. At this time, the spring that is compressed below the connecting disk 131 will provide an elastic force to the refillable sprayer 40 to enable the refillable sprayer 40 to move upwardly relative to the connecting jacket 13 as shown in FIG. 6. Finally, the refillable sprayer 40 has been filled up with the pressurized gas and oil by the auto-filling assembly for a refillable sprayer in accordance with the present invention automatically.

According to the above-mentioned features and operations, the user only needs to mount a refillable sprayer 40 into the connecting jacket 13, then the auto-filling assembly for a refillable sprayer in accordance with the present invention can be used to fill the pressurized gas and oil into the refillable sprayer 40 conveniently and automatically. In the operation of filling pressurized gas and oil, the oil that is stored in the storage bottle 31 can flow and be filled in the refillable sprayer 40 by the pressurized gas driving the extruding shaft 311 to move relative to the storage bottle 31. After filling the oil in the refillable sprayer 40, the mechanical valve 33 can be switched to control the flowing direction of the pressurized gas to enable the pressurized gas to flow and be filled in the refillable sprayer 40 and to enable the extruding shaft 311 and the touching panel 312 to move back to the original position by the returning spring 313. Then, the oil that is stored in the oil tank 12 can be drawn to fill in the storage bottle 31 and the storage bottle 31 can be used to fill oil into another refillable sprayer 40. After filling oil into the refillable sprayer 40, the spring of the connecting disk 131 can provide an elastic force to the refillable sprayer 40 to enable the refillable sprayer 40 to move upwardly relative to the connecting jacket 13. Consequently, the pressurized gas and oil can be filled into the refillable sprayer 40 by the auto-filling assembly for a refillable sprayer in accordance with the present invention conveniently and automatically.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An auto-filling assembly for a refillable sprayer, comprising:

a base device having:

a base having a top face;

an oil tank mounted in the base; and a connecting jacket securely mounted on the top face of the base and having:

a bottom end;

a top end;

an external surface;

a connecting disk movably mounted in the connecting jacket at the bottom end of the connecting jacket;

a switch mounted on the external surface of the connecting jacket near the bottom end of the connecting jacket and having a touching leg extending into the connecting jacket; and an engaging mount securely mounted on the external surface of the connecting jacket near the top end of the connecting jacket;

a controlling device connected to the base device and having:

an inlet valve mounted on the top face of the base and having an air pipe connected to the switch;

a first linking valve mounted on the top face of the base, connected to the switch and having:

a first inlet-connecting pipe connected to the switch and communicating with the air pipe of the inlet valve via the switch; and a first outlet-connecting pipe;

a gas-controlling valve mounted on the top face of the base, connected to the first linking valve and having:

an inlet controlling pipe; and an outlet controlling pipe;

a second linking valve mounted on the top face of the base, connected to the outlet controlling pipe of the gas-controlling valve and having:

a second inlet-connecting pipe; and a second outlet-connecting pipe; and a triple valve mounted on the top face of the base, connected to the second outlet-connecting pipe of the second linking valve and having:

an oil entrance pipe; and an oil-gas filling pipe connected to a center of the connecting disk via the bottom end of the connecting jacket; and a filling device mounted on the base device, connected to the controlling device and having:

a storage bottle transversally mounted on the top face of the base, connected to the oil entrance pipe and the inlet controlling pipe of the controlling device and having:

a distal end;

a proximal end;

an extruding shaft movably connected to the distal end of the storage bottle and having a free end opposite to the storage bottle;

a touching panel connected to the free end of the extruding shaft and having an inner side and an outer side; and a returning spring mounted around the extruding shaft and abutting the inner side of the touching panel and the distal end of the storage bottle;

a release valve securely mounted on the top face of the base, connected to the first outlet-connecting pipe of the first linking valve and selectively abutting the outer side of the touching panel of the storage bottle; and a mechanical valve mounted on the storage bottle, connected to the second inlet-connecting pipe of the second linking valve and selectively abutting the inner side of the touching panel and having a linking pipe communicating with the first linking valve.

2. The auto-filling assembly for a refillable sprayer as claimed in claim 1, wherein the base has a through hole formed through the top face of the base;

the oil tank has a transfer pipe extending out of the top face of the base via the through hole;

the triple valve is connected to the transfer pipe of the oil tank.

3. The auto-filling assembly for a refillable sprayer as claimed in claim 2, wherein the engaging mount has an inner side abutting the external surface of the connecting jacket;

an outer side;

a pressure cylinder securely mounted on the outer side of the engaging mount; and an engaging rod connected to the pressure cylinder to be movably mounted in the engaging mount and extending into the connecting jacket via the inner side of the engaging mount and the external surface of the connecting jacket; and the release valve has a release pipe connected to the pressure cylinder of the engaging mount to enable the engaging rod to move relative to the connecting jacket.

4. The auto-filling assembly for a refillable sprayer as claimed in claim 3, wherein the controlling device has multiple reverse valves respectively mounted on the second inlet-connecting pipe, the second outlet-connecting pipe and the transfer pipe.

5. The auto-filling assembly for a refillable sprayer as claimed in claim 4, wherein the storage bottle is transversally mounted on the top face of the base by a mounting frame; and the mechanical valve is mounted on the mounting frame above the storage bottle.

6. The auto-filling assembly for a refillable sprayer as claimed in claim 2, wherein the controlling device has multiple reverse valves respectively mounted on the second inlet-connecting pipe, the second outlet-connecting pipe and the transfer pipe.

7. The auto-filling assembly for a refillable sprayer as claimed in claim 1, wherein the storage bottle is transversally mounted on the top face of the base by a mounting frame; and the mechanical valve is mounted on the mounting frame above the storage bottle.

8. The auto-filling assembly for a refillable sprayer as claimed in claim 1, wherein the engaging mount has an inner side abutting the external surface of the connecting jacket;

an outer side;

a pressure cylinder securely mounted on the outer side of the engaging mount; and an engaging rod connected to the pressure cylinder to be movably mounted in the engaging mount and extending into the connecting jacket via the inner side of the engaging mount and the external surface of the connecting jacket; and the release valve has a release pipe connected to the pressure cylinder of the engaging mount to enable the engaging rod to move relative to the connecting jacket.

9. The auto-filling assembly for a refillable sprayer as claimed in claim 8, wherein the controlling device has multiple reverse valves respectively mounted on the second inlet-connecting pipe, the second outlet-connecting pipe and the transfer pipe.

10. The auto-filling assembly for a refillable sprayer as claimed in claim 9, wherein the storage bottle is transversally mounted on the top face of the base by a mounting frame; and the mechanical valve is mounted on the mounting frame above the storage bottle.

* * * * *